US007938706B2

(12) United States Patent
Honda et al.

(10) Patent No.: US 7,938,706 B2
(45) Date of Patent: May 10, 2011

(54) DEFLECTION INSPECTING DEVICE FOR SPARK PLUG INSULATOR, DEFLECTION INSPECTING METHOD FOR SPARK PLUG INSULATOR, AND MANUFACTURING METHOD FOR SPARK PLUG INSULATOR

(75) Inventors: Toshitaka Honda, Iwakura (JP); Hirokazu Kurono, Nagoya (JP)

(73) Assignee: NGK Spark Plug Co., Ltd., Nagoya, Aichi (JP)

( * ) Notice: Subject to any disclaimer, the term of this patent is extended or adjusted under 35 U.S.C. 154(b) by 71 days.

(21) Appl. No.: 12/529,827

(22) PCT Filed: Nov. 18, 2008

(86) PCT No.: PCT/JP2008/070956

§ 371 (c)(1),
(2), (4) Date: Sep. 3, 2009

(87) PCT Pub. No.: WO2009/066669

PCT Pub. Date: May 28, 2009

(65) Prior Publication Data

US 2010/0093246 A1 Apr. 15, 2010

(30) Foreign Application Priority Data

Nov. 19, 2007 (JP) ..... 2007-299715

(51) Int. Cl.
*F23Q 23/08* (2006.01)

(52) U.S. Cl. ..... 445/3; 445/7; 33/533; 313/118; 313/132; 313/142

(58) Field of Classification Search ..... 445/3, 7; 33/533; 313/118, 132, 142
See application file for complete search history.

(56) References Cited

U.S. PATENT DOCUMENTS

| | | | | |
|---|---|---|---|---|
| 5,639,953 | A * | 6/1997 | Renslow | 73/1.73 |
| 7,795,791 | B2 * | 9/2010 | Joseph et al. | 313/141 |
| 2009/0215348 | A1 * | 8/2009 | Honda et al. | 445/7 |
| 2009/0239437 | A1 * | 9/2009 | Honda et al. | 445/7 |

FOREIGN PATENT DOCUMENTS

| | | |
|---|---|---|
| JP | 4-92385 | 3/1992 |
| JP | 2002-305069 | 10/2002 |
| JP | 2006-185795 | 7/2006 |
| JP | 2007-134132 | 5/2007 |

* cited by examiner

*Primary Examiner* — Peter J. Macchiarolo
*Assistant Examiner* — Mary Ellen Bowman
(74) *Attorney, Agent, or Firm* — Stites & Harbison PLLC; Jeffrey A. Haeberlin

(57) ABSTRACT

A device for inspecting a spark plug insulator for bending, the spark plug insulator including a cylindrical body having a radially enlarged flange at an axially intermediate portion thereof, and a through hole formed in the body along an axial direction of the body. The inspection device includes an insulator supporting means for supporting the spark plug insulator so as to be slidable in an axial direction of the spark plug insulator, a linear inspection pin that is to be inserted into the through hole of the spark plug insulator supported by the insulator supporting means, and a detecting means for detecting a sliding movement of the spark plug insulator when the spark plug insulator is caused to slide in the axial direction thereof by the inspection pin by the inspection pin prevented from completely penetrating the through hole of the spark plug insulator owing to bending of the spark plug insulator which exceeds a predetermined tolerance.

9 Claims, 3 Drawing Sheets

DEFLECTION INSPECTING DEVICE FOR SPARK PLUG INSULATOR, DEFLECTION INSPECTING METHOD FOR SPARK PLUG INSULATOR, AND MANUFACTURING METHOD FOR SPARK PLUG INSULATOR

TECHNICAL FIELD

The present invention relates to a device for inspecting a spark plug insulator for bending which constitutes a spark plug useable for ignition in an internal combustion engine, a method for inspecting a spark plug insulator for bending, and a method for manufacturing the spark plug insulator. More specifically, the present invention relates to a device for inspecting a spark plug insulator for bending and a method for inspecting a spark plug insulator for bending with high inspection efficiency and high inspection accuracy, and a method for manufacturing the spark plug insulator.

BACKGROUND ART

In a spark plug that is used in an internal combustion engine such as an automobile engine, an alumina material sintered body made by sintering an alumina ($Al_2O_3$) insulating material is practically used as a spark plug insulator (hereinafter also referred to as simply "insulator") which constitutes the spark plug. The reason for using the alumina material sintered body as the insulator is that alumina is excellent in heat resistance, mechanical properties and dielectric strength. Generally, the insulator is formed into an elongated shape in an axial direction thereof and formed with a through hole that extends in the axial direction of the insulator. The through hole receives a center electrode that is opposed to a ground electrode so as to form a spark discharge gap therebetween, and a terminal electrode for applying high discharge voltage to the center electrode.

The insulator is produced by baking a compact formed of raw material powder. More specifically explaining a generally known method for manufacturing the insulator, first, raw material powder containing alumina powder as a main component is mixed with an organic bonding agent (i.e., a so-called binder) and water as a solvent. The thus formed admixture is wet-blended to form a slurry. The slurry is dried by a suitable method such as spray drying, and then granulated. Next, the granulated material is formed into a compact having a given shape of the above-described insulator and then baked to thereby produce the insulator. There has been conventionally used the raw material powder containing alumina powder as a main component as described above, and specifically, the raw material powder having an average grain size of 2 μm in view of stabilization of quality of the insulator and cost saving and productivity of the insulator (for instance, see Patent Literature 1).

The insulator formed by the baking was shrunk by about 20% as compared to that before being baked. In a case where the shrinkage occurs non-uniformly upon the baking, bending (warpage or deflection) occurs in the insulator. The bending of the insulator causes a tip end of the center electrode to be displaced from an axis of the center electrode upon assembling the center electrode to the insulator. If the tip end of the center electrode is displaced from the axis of the center electrode, there may occur ignition failure that in turn causes failure in ignition which tends to be ordinarily generated between the center electrode and the ground electrode. That is, there may occur a so-called transverse flying spark that is generated between the center electrode and a main metallic fitting that is disposed on an outer circumferential periphery of the center electrode. Therefore, the bending of the insulator is one of most considerable defects which lead to deterioration in performance of the spark plug.

Conventionally, there have been proposed a method for inspecting insulators for bending in which the insulators are subjected to visual inspection as to whether or not any deflection is caused in the insulators while the insulators are rotated one by one about a longitudinal axis thereof.

However, in the above-described inspection method for the insulator, since the presence of the bending of the insulator is determined by the visual inspection, excessive detection of the bending will be frequently caused to thereby decrease the inspection accuracy.

Patent Literature 1: Japanese Patent Application First Publication No. 2002-305069

SUMMARY OF INVENTION

The present invention has been made in view of the above problem in the conventional art. An object of the present invention is to provide a device for inspecting a spark plug insulator for bending, a method for inspecting a spark plug insulator for bending, in which the inspection can be performed with an enhanced inspection accuracy, and a method for manufacturing the spark plug insulator.

To solve the above problem in the conventional art, in a first aspect of the present invention, there is provided a device (a first device) for inspecting a spark plug insulator for bending, the spark plug insulator including a cylindrical body having a radially enlarged flange at an axially intermediate portion thereof, and a through hole that is formed in the body along an axial direction of the body, the device comprising:

an insulator supporting means for supporting the spark plug insulator so as to be slidable in an axial direction of the spark plug insulator;

a linear inspection pin that is to be inserted into the through hole of the spark plug insulator supported by the insulator supporting means; and a detecting means for detecting a sliding movement of the spark plug insulator when the spark plug insulator is caused to slide in the axial direction thereof by the inspection pin that is prevented from completely penetrating the through hole of the spark plug insulator owing to bending of the spark plug insulator which exceeds a predetermined tolerance.

The first device may be a device (a second device) for inspecting the spark plug insulator for bending, in which the insulator supporting means is a holder plate having a holding hole that is engaged with the flange to thereby support the spark plug insulator.

The first or second device may be a device (a third device) for inspecting the spark plug insulator for bending, in which the insulator supporting means supports a plurality of the spark plug insulators which are arranged in a row or rows, and a plurality of the inspection pins are correspondingly arranged in a row or rows.

Any one of the first to third device may be a device (a fourth device) for inspecting the spark plug insulator for bending, in which the detecting means is an ink pad that is impregnated with an ink, and the sliding movement of the spark plug insulator is detected by adhesion of the ink to a tip end of the spark plug insulator.

Any one of the first to third devices may be a device (a fifth device) for inspecting the spark plug insulator for bending, in which the inspection pin has an electric conductivity and the detecting means includes a contact portion that has an electric conductivity and is so disposed as to come into contact with the inspection pin when the inspection pin is moved to penetrate the through hole, the contact portion cooperating with the inspection pin to form an electric conduction device, wherein the sliding movement of the spark plug insulator is detected when the inspection pin is prevented from coming into contact with the contact portion and fails to establish an electric conduction therebetween.

Any one of the first to third device may be a device (a sixth device) for inspecting the spark plug insulator for bending, in which the detecting means is configured to check the sliding movement of the spark plug insulator by visual observation.

Any one of the first to third devices may be a device (a seventh device) for inspecting the spark plug insulator for bending, in which the detecting means is an optical sensor that is constructed to detect the sliding movement of the spark plug insulator on the basis of change in quantity of light received by the optical sensor.

In a second aspect of the present invention, there is provided a method for inspecting the spark plug insulator for bending by using any one of the first to seventh device according to the present invention, the method comprising the steps of:

moving at least one of the inspection pin and the insulator supporting means with the spark plug insulator supported thereon, so as to approach to each other and inserting the inspection pin into the through hole of the spark plug insulator; and determining presence or absence of bending in the spark plug insulator by detecting the sliding movement of the spark plug insulator using the detecting means.

In a third aspect of the present invention, there is provided a method for manufacturing a spark plug insulator, the spark plug insulator including a cylindrical body having a radially enlarged flange at an axially intermediate portion thereof, and a through hole formed in the body along an axial direction of the body, the method comprising the steps of:

producing the spark plug insulator with the body and the through hole by baking a compact formed from a raw material powder;

inserting a linear inspection pin into the through hole of the spark plug insulator produced in the previous step under a condition that the spark plug insulator is slidably supported in an axial direction thereof; and determining presence or absence of bending in the spark plug insulator by detecting occurrence or non-occurrence of an axial sliding movement of the spark plug insulator by insertion of the inspection pin.

DETAILED DESCRIPTION OF INVENTION

Figure 1A:
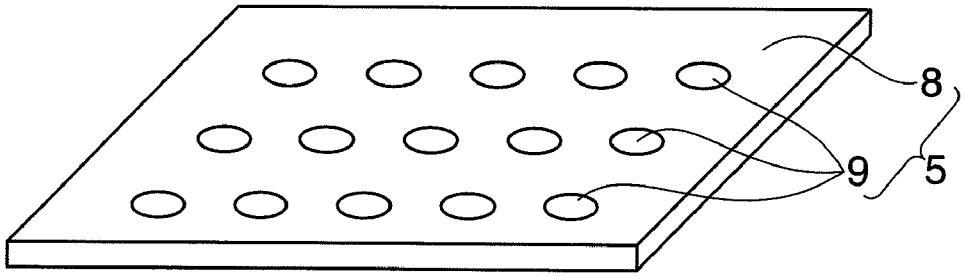
FIG. 1A is a perspective view of a device (an insulator supporting means) for inspecting a spark plug insulator for bending, according to an embodiment of the invention, before setting the spark plug insulator to the device.

In the device (4) and the method for inspecting a spark plug insulator (1) for bending of the present invention, if the spark plug insulator (1) has a bend as a defect, the spark plug insulator can be pushed out (or slid) by an inspection pin (6). Therefore, it is possible to remarkably facilitate detection of the bending of the spark plug insulator (1) as compared to the conventional visual inspection in which deflection of the spark plug insulator (1) is checked by naked eyes by rotating the spark plug insulator (1). As a result, an accuracy in the bending inspection can be enhanced.

Further, in a case where an insulator supporting means (5) is a holder plate (8) having a holding hole (9), it is possible to realize the insulator supporting means (5) with a simple structure and a reduced cost. Further, even if the spark plug insulators (1) are of different types which are different in size in a longitudinal direction thereof from each other, the spark plug insulators can be inspected using the same device (4) as long as the body (10) and the flange (3) of the spark plug insulators (1) have the same diameters, respectively. Therefore, the device has an increased flexibility.

Further, in a case where a plurality of the spark plug insulators (1) are supported in a row or rows by the insulator supporting means (5) and a plurality of the inspection pins (6) are correspondingly arranged in a row or rows, the plurality of the spark plug insulators (1) can be simultaneously inspected. As a result, it is possible to remarkably increase an inspection efficiency as compared to the conventional case where the spark plug insulators are inspected one by one.

Further, in a case where the detecting means (7) is an ink pad, the ink can be adhered to a tip end portion of the spark plug insulator (1) that has a bend as a defect. Therefore, even after removing the inspecting pin (6) from the spark plug insulator, the bent spark plug insulator (1) can be readily detected. As a result, it is possible to enhance the inspection efficiency. In particular, in a case where a plurality of the spark plug insulators (1) are simultaneously inspected, the bent spark plug insulator (1) can be readily distinguished from the remaining normal spark plug insulators (1) by using the ink pad as the detecting means (7) even after the inspecting pins (6) are removed from the spark plug insulators. Therefore, it is possible to perform simultaneous inspection of the plurality of the spark plug insulators (1) and further enhance the inspection efficiency.

Further, in a case where the inspection pin (6) has an electric conductivity and the detecting means (7) includes a contact portion that has an electric conductivity and is so disposed as to come into contact with the inspection pin (6) when the inspection pin (6) is moved to penetrate the through hole (2), the contact portion cooperating with the inspection pin (6) to form an electric conduction device, wherein the sliding movement of the spark plug insulator (1) can be detected when the inspection pin (6) is prevented from penetrating the through hole (2) and coming into contact with the contact portion and fails to establish an electric conduction therebetween. As a result, it is possible to automatically and readily perform the inspection of the spark plug insulator and thereby enhance the inspection efficiency.

Further, in a case where the detecting means (7) is configured to check the sliding movement of the spark plug insulator (1) by visual observation, it is unnecessary to use a special device serving as the detecting means, and therefore, the inspection can be performed with a reduced cost.

Further, in a case where the detecting means (7) is an optical sensor, the sliding movement of the spark plug insulator (1) can be detected on the basis of change in quantity of light received by the optical sensor. As a result, it is possible to automatically and readily perform the inspection of the spark plug insulator and thereby enhance the inspection efficiency.

Further, in the method for manufacturing a spark plug insulator (1) according to the present invention, in the step of producing the spark plug insulator (1), it is possible to readily detect bending of the spark plug insulator (1) and thereby surely determine presence or absence of bending in the spark plug insulator (1). Accordingly, in the step of producing the spark plug insulator (1), the spark plug insulator (1) can be produced while certainly excluding a defective one.

As explained above, the present invention can be widely applied to general inspections of a spark plug insulator constituting a spark plug that is used for ignition in an internal combustion engine. In particular, the present invention can suitably provide a device for inspecting a spark plug insulator for bending and a method for inspecting the spark plug insulator for bending, in which it is required to perform the inspection with a high inspection efficiency and a high inspection accuracy, and a method for manufacturing the spark plug insulator which includes the step of inspection for bending as described above.

The present invention is explained hereinafter with reference to the accompanying drawings.

Device 4 for inspecting spark plug insulator 1, according to an embodiment, includes insulator supporting means 5, inspection pin 6 and detecting means 7.

The above-described "spark plug insulator (1)" includes cylindrical body 10 having radially enlarged flange 3 formed at an axially intermediate portion of body 10. Through hole 2 is formed in body 10 along an axial direction of body 10, into which a center electrode and a terminal electrode are inserted. Spark plug insulator 1 is not limited to specific ones with respect to size, shape, material and number as long as through hole 2 is formed in body 10 along the axial direction of body 10 as described above.

The above-described "insulator supporting means (5)" is not limited to specific ones with respect to size, shape, material and number as long as insulator supporting means 5 supports spark plug insulator 1 so as to be slidable in an axial direction of spark plug insulator 1. Insulator supporting means 5 may be configured into holder plate 8 having holding hole 9 in which spark plug insulator 1 is supported by engagement between a peripheral edge of holding hole 9 and flange 3. In this case, by setting holder plate 8 substantially horizontally, spark plug insulator 1 can be inserted into holding hole 9 from above until flange 3 is engaged with the peripheral edge of holding hole 9 to thereby support spark plug insulator 1.

The above-described "inspection pin (6)" is not limited to a specific one with respect to size, shape, material and number as long as inspection pin 6 is inserted into through hole 2 of spark plug insulator 1 that is supported by insulator supporting means 5. A plurality of inspection pins 6 can be arranged in a row or multiple rows. As a diameter of inspection pin 6 becomes closer to a diameter of through hole 2, inspection pin 6 can more sensitively interfere with a bend of through hole 2 upon insertion thereof. Therefore, the inspection accuracy can be enhanced by increasing the diameter of inspection pin 6.

The above-described "detecting means (7)" is not limited to a specific one with respect to the detection method as long as detecting means (7) detects a sliding movement of spark plug insulator 1 when spark plug insulator 1 is caused to slide in the axial direction thereof by inspection pin 6 that is prevented from completely penetrating through hole 2 of spark plug insulator 1 owing to bending of spark plug insulator 1 which exceeds a predetermined tolerance. For instance, detecting means 7 can be an ink pad that is impregnated with an ink and brought into contact with a tip end of spark plug insulator 1 when slid. Specifically, when spark plug insulator 1 is caused to slide by inspection pin 6 such that the tip end thereof comes into contact with the ink pad, the ink in the ink pad is adhered to the tip end of spark plug insulator 1. Thus, the sliding movement of spark plug insulator 1 can be detected by the adhesion of the ink. Further, inspection pin 6 can have an electric conductivity, and detecting means 7 can include a contact portion that has an electric conductivity and is so disposed as to come into contact with inspection pin 6 when the inspection pin 6 is moved to penetrate through hole 2. The contact portion thus cooperates with inspection pin 6 to form an electric conduction device. That is, the sliding movement of spark plug insulator 1 can be detected when spark plug insulator 1 is slid by inspection pin 6 that is prevented from penetrating through hole 2 and coming into contact with the contact portion and thereby fails to establish an electric conduction between inspection pin 6 and the contact portion. Further, detecting means 7 can be configured to check the slide movement of spark plug insulator 1 by visual observation. Further, detecting means 7 can be a photoelectric sensor that is constructed to detect the sliding movement of spark plug insulator 1 on the basis of change in quantity of light received by a light-receptor element of the photoelectric sensor which is caused when spark plug insulator 1 intercepts or reflects the light during the sliding movement.

DESCRIPTION OF EMBODIMENTS

An embodiment of the present invention is explained in more detail hereinafter with reference to the accompanying drawings. Spark plug insulator 1 that is used as an object to be inspected in the embodiment is a spark plug insulator after baking but before glazing.

(1) Construction of the Embodiment

Figure 1B:
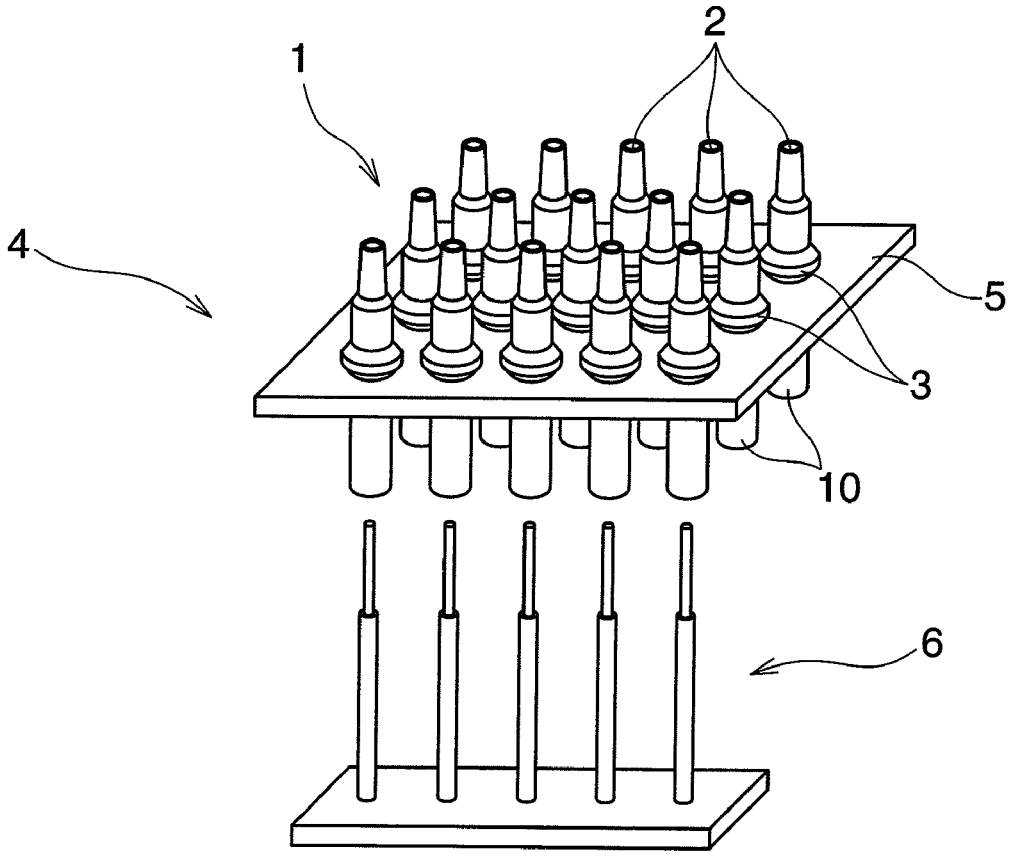
FIG. 1B is a perspective view of the device for inspecting a spark plug insulator for bending, according to the embodiment of the invention, after setting the spark plug insulator to the device.
Figure 1C:
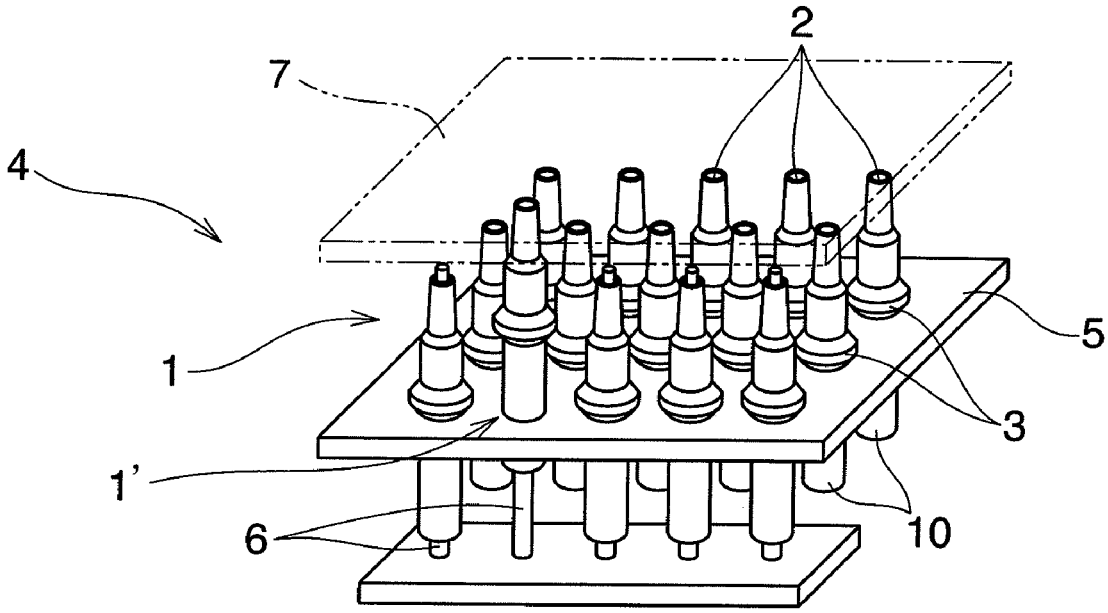
FIG. 1C is a perspective view of the device for inspecting a spark plug insulator for bending, according to the embodiment of the invention, showing the spark plug insulator undergoing the inspection.
Figure 2:
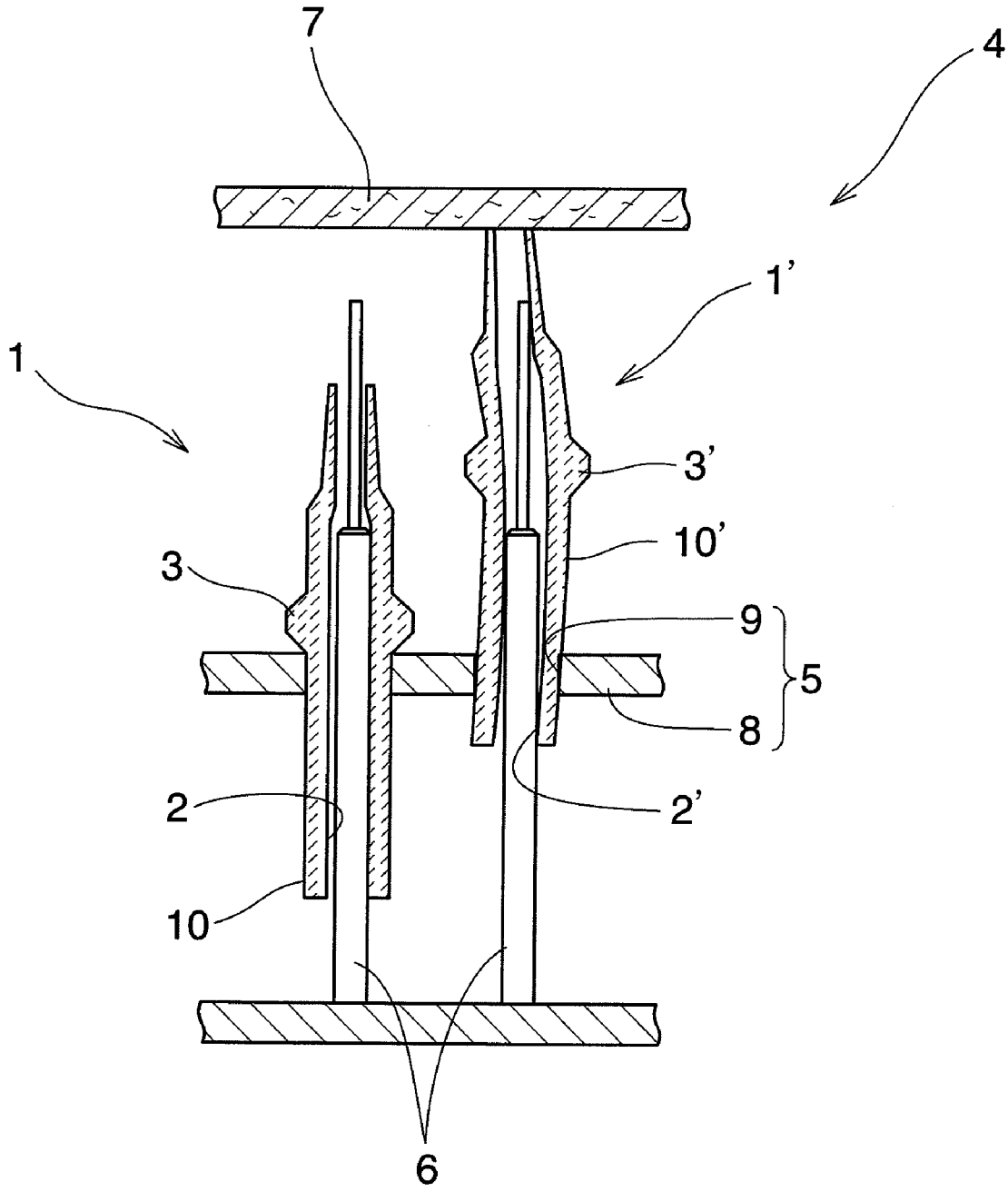
FIG. 2 is a vertical sectional view of the spark plug insulator with an inspection pin inserted into the spark plug insulator.

As shown in FIG. 1B, FIG. 1C and FIG. 2, spark plug insulator 1 as an object to be inspected in the embodiment includes cylindrical body 10 having a radially enlarged flange 3 that is formed at an axially intermediate portion of body 10. Spark plug insulator 1 further includes through hole 2 formed in body 10 along an axial direction of body 10 for insertion of a center electrode and a terminal electrode thereinto. Specifically, in FIG. 1B, FIG. 1C and FIG. 2, spark plug insulator 1 has a base portion on a lower side of flange 3 which has a cylindrical straight barrel shape, and a tip end portion on an upper side of flange 3 which has a tapered shape gradually reduced in diameter toward a tip end thereof. Through hole 2 is a stepped hole having an inner diameter on a side of the tip end portion of spark plug insulator 1 which is smaller than an inner diameter on a side of the base portion of spark plug insulator 1. In general, the inner diameter of through hole 2 on the side of the base portion is about 3 to 5 mm, and the inner diameter of through hole 2 on the side of the tip end portion is about 1 to 3 mm.

Device 4 for inspecting spark plug insulator 1 for bending, according to the embodiment, includes insulator supporting member (insulator supporting means) 5 that supports spark plug insulator 1, inspection pin 6 that is to be inserted into through hole 2 of spark plug insulator 1, and detecting member (detecting means) 7 that detects a sliding movement of spark plug insulator 1.

As shown in FIG. 1A, insulator supporting member 5 is constituted of holder plate 8 substantially horizontally disposed and a plurality of holding holes 9 formed in holder plate 8. Each of holding holes 9 has a diameter that is smaller than an outer diameter of flange of spark plug insulator 1 and larger than an outer diameter of body 10 on the base portion of spark plug insulator 1. With this configuration of holding hole 9, when body 10 of spark plug insulator 1 is inserted into holding hole 9, flange 3 is engaged with the peripheral edge of holding hole 9 as shown in FIG. 1B, so that spark plug insulator 1 is vertically supported and upwardly slidable in the axial direction thereof. Holding holes 9 are arranged in multiple rows at a predetermined interval between adjacent holding holes 9.

Inspection pin 6 straightly linearly extends and has a stepped shape having a tapered tip end portion similar to an inner circumferential surface of through hole 2. Inspection pin 6 has a large diameter portion having an outer diameter smaller by about 1% to 3% than the inner diameter of through hole 2 on the side of the base portion of spark plug insulator 1. Inspection pin 6 also has a small diameter portion having an outer diameter smaller by about 1% to 3% than the inner diameter of through hole 2 on the side of the tip end portion of spark plug insulator 1. In this embodiment, a plurality of inspection pins 6 are arranged in a row and inserted into through hole 2 from a lower side of spark plug insulators 1 vertically supported by insulator supporting member 5.

Detecting member 7 is disposed in a position where the tip end of spark plug insulator 1 is brought into contact with detecting member 7 when spark plug insulator 1 is caused to upwardly slide in the axial direction thereof by inspection pin 6 that is prevented from completely penetrating through hole 2 owing to bending of spark plug insulator 1 which exceeds a predetermined tolerance. In this embodiment, detecting member 7 is an ink pad impregnated with an ink.

(2) Operation of the Embodiment

An operation of inspecting spark plug insulator 1 according to the above-described embodiment will be explained.

(Insertion Step)

First, spark plug insulators 1 are inserted into holding holes 9 of insulator supporting member 5 as shown in FIG. 1A and supported by insulator supporting member 5 as shown in FIG. 1B. Detecting member 7 is placed above spark plug insulators 1 at a suitable distance therefrom. After that, as shown in FIG. 1C, inspection pins 6 are upwardly moved from a lower side of insulator supporting member 5 and inserted into through holes 2 of spark plug insulators 1.

(Step of Determining Presence or Absence of Defect)

As shown in FIG. 1C and FIG. 2, in a case where bending of spark plug insulator 1 is within the predetermined tolerance, inspection pin 6 can be moved to penetrate through hole 2 and project beyond the tip end portion of spark plug insulator 1 so that spark plug insulator 1 is free from the sliding movement relative to insulator supporting member 5 as shown on the left side of FIG. 2. In contrast, in a case where bending of spark plug insulator 1' exceeds the predetermined tolerance, inspection pin 6 can interfere with a bend of through hole 2' which is located in the axial direction of spark plug insulator 1', and can upwardly push spark plug insulator 1' and cause the slide movement of spark plug insulator 1' relative to insulator supporting member 5 as shown on the right side of FIG. 2. The tip end of spark plug insulator 1 upwardly pushed is contacted with detecting member 7 to thereby cause adhesion of the ink to the tip end of spark plug insulator 1.

Subsequently, inspection pins 6 are downwardly pulled and removed from spark plug insulator 1, and then detecting member 7 is moved apart from spark plug insulators 1. At this time, all of spark plug insulators 1 are supported by insulator supporting member 5 again, and it is determined that spark plug insulator 1 with the ink adhered to the tip end thereof suffers from the bending as a defect. Spark plug insulator 1 suffering from the bending is then rejected and removed.

(3) Effect of the Embodiment

According to the embodiment, since an ink pad is used as detecting member 7, spark plug insulator 1 with bending can be readily distinguished from multiple normal spark plug insulators 1 even after removing inspection pins 6 therefrom. This results in enhancing the inspection efficiency. Further, since a plurality of inspection pins 6 are arranged in a row, a plurality of spark plug insulators 1 can be inspected at the same time. As a result, it is possible to enhance the inspection efficiency and increase the productivity.

Further, respective spark plug insulators 1 are supported at flanges 3 by merely the engagement with the peripheral edges of holding holes 9 of insulator supporting member 5. With this arrangement, respective spark plug insulators 1 can be readily upwardly slid relative to insulator supporting member 5. Accordingly, when inspection pin 6 is inserted into through hole 2 from the lower side of spark plug insulator 1 with the bending, inspection pin 6 can be prevented from being bent along through hole 2. Therefore, it is possible to suppress deterioration in inspection accuracy.

The present invention is not limited to the embodiment described above. Modifications and variations of the embodiment described above will be made in accordance with an object and application unless departing from the scope of the invention. Specifically, although the ink pad is used as detecting member 7 in the embodiment described above, a sensor that detects the sliding movement of spark plug insulator 1 can be used without being limited to the ink pad. A non-contact sensor such as an optical sensor, or a contact sensor such as a micro switch can also be used for detecting the sliding movement of spark plug insulator 1. In this case, the sliding movement of spark plug insulator 1 can be automatically detected, and therefore, an operability of the inspecting device can be enhanced.

Further, inspection pin 6 can have an electric conductivity, and detecting member 7 can include a contact portion that has an electric conductivity and is so disposed as to come into contact with a tip end of inspection pin 6 which penetrates through hole 2 and projects beyond the tip end portion of spark plug insulator 1 to thereby establish an electric conduction between inspection pin 6 and the contact portion. The contact portion thus cooperates with inspection pin 6 to form an electric conduction device. In this case, for instance, a terminal as the contact portion is provided at the tip end portion of spark plug insulator 1, and it is determined whether or not inspection pin 6 is contacted with the contact portion. The sliding movement of spark plug insulator 1 can be automatically detected, and therefore, an operability of the inspecting device can be enhanced.

Further, detecting member 7 can be configured to check the sliding movement of spark plug insulator 1 by visual observation. In this case, detecting member 7 can be obtained at a reduced cost.

Further, although horizontal holder plate 8 with holding holes 9 which serves as insulator supporting member 5 is used in the above-described embodiment, a horizontal grid with multiple holding holes can be used without being limited to holder plate 8. Further, spark plug insulators 1 of the above-described embodiment are supported so as to be slidable only in an upward direction, but the sliding movement of spark plug insulators 1 is not limited to the above-described embodiment. Spark plug insulators 1 can be supported so as to be slidable in a downward direction or in a horizontal direction or slidable at a certain angle relative to the horizontal direction. In this case, inspection pins 6 can be inserted into spark plug insulators 1 in the same direction as the direction of the sliding movement of spark plug insulators 1.

Further, although a plurality of inspection pins 6 are arranged in a row in the above-described embodiment, the arrangement of inspection pins 6 is not limited to the above-described embodiment. For instance, a plurality of inspection pins 6 can be arranged in a plurality of rows, or a single inspection pin 6 can be used.

Further, although spark plug insulators 1 are slidably supported in the above-described embodiment, spark plug insulators 1 can be fixedly supported without being limited to the above-described embodiment. In this case, inspection pins 6 can be slidably supported and inserted into spark plug insulators 1 to thereby detect the sliding movement of inspection pins 6.

Further, the method for manufacturing spark plug insulator 1 can include the step of inserting spark plug insulator 1 and the step of determining presence or absence of bending in spark plug insulator 1. That is, the step of inserting spark plug insulator 1 and the step of determining presence or absence of bending in spark plug insulator 1 in the above-described embodiment are conducted subsequent to the step of producing spark plug insulator 1 with body 10 and through hole 2 by forming a compact from a raw material powder for the spark plug insulator, such as alumina powder, and baking the compact after forming the compact. In such a method for manufacturing spark plug insulator 1, it is possible to readily detect bending as a defect of spark plug insulator 1 and thereby certainly determine presence or absence of the bending in spark plug insulator 1. Accordingly, in the method for manufacturing spark plug insulator 1, it is possible to manufacture spark plug insulator 1 with certainly rejecting the defective product.

The invention claimed is:

1. A device for inspecting a spark plug insulator for bending, the spark plug insulator including a cylindrical body having a radially enlarged flange at an axially intermediate portion thereof, and a through hole that is formed in the body along an axial direction of the body, the device comprising:

an insulator supporting means for supporting the spark plug insulator so as to be slidable in an axial direction of the spark plug insulator;

a linear inspection pin that is to be inserted into the through hole of the spark plug insulator supported by the insulator supporting means; and a detecting means for detecting a sliding movement of the spark plug insulator when the spark plug insulator is caused to slide in the axial direction thereof by the inspection pin that is prevented from completely penetrating the through hole of the spark plug insulator owing to bending of the spark plug insulator which exceeds a predetermined tolerance.

2. The device for inspecting a spark plug insulator for bending as claimed in claim 1, wherein the insulator supporting means is a holder plate having a holding hole that is engaged with the flange to thereby support the spark plug insulator.

3. The device for inspecting a spark plug insulator for bending as claimed in claim 1, wherein the insulator supporting means supports a plurality of the spark plug insulators which are arranged in a row or rows, and a plurality of the inspection pins are correspondingly arranged in a row or rows.

4. The device for inspecting a spark plug insulator for bending as claimed in claim 1, wherein the detecting means is an ink pad that is impregnated with an ink, and the sliding movement of the spark plug insulator is detected by adhesion of the ink to a tip end of the spark plug insulator.

5. The device for inspecting a spark plug insulator for bending as claimed in claim 1, wherein the inspection pin has an electric conductivity and the detecting means includes a contact portion that has an electric conductivity and is so disposed as to come into contact with the inspection pin when the inspection pin is moved to penetrate the through hole, the contact portion cooperating with the inspection pin to form an electric conduction device, wherein the sliding movement of the spark plug insulator is detected when the inspection pin is prevented from coming into contact with the contact portion and fails to establish an electric conduction therebetween.

6. The device for inspecting a spark plug insulator for bending as claimed in claim 1, wherein the detecting means is configured to check the sliding movement of the spark plug insulator by visual observation.

7. The device for inspecting a spark plug insulator for bending as claimed in claim 1, wherein the detecting means is an optical sensor that is constructed to detect the sliding movement of the spark plug insulator on the basis of change in quantity of light received by the optical sensor.

8. A method for inspecting a spark plug insulator for bending by using the device for inspecting a spark plug insulator for bending as claimed in claim 1, the method comprising the steps of:

moving at least one of the inspection pin and the insulator supporting means with the spark plug insulator supported thereon, so as to approach to each other and inserting the inspection pin into the through hole of the spark plug insulator; and determining presence or absence of bending in the spark plug insulator by detecting the sliding movement of the spark plug insulator using the detecting means.

9. A method for manufacturing a spark plug insulator, the spark plug insulator including a cylindrical body having a radially enlarged flange at an axially intermediate portion thereof, and a through hole formed in the body along an axial direction of the body, the method comprising the steps of:

producing the spark plug insulator with the body and the through hole by baking a compact formed from a raw material powder;

inserting a linear inspection pin into the through hole of the spark plug insulator produced in the previous step under a condition that the spark plug insulator is slidably supported in an axial direction thereof; and determining presence or absence of bending in the spark plug insulator by detecting occurrence or non-occurrence of an axial sliding movement of the spark plug insulator by insertion of the inspection pin.

* * * * *